US009888307B2

(12) United States Patent
Vitt et al.

(10) Patent No.: US 9,888,307 B2
(45) Date of Patent: Feb. 6, 2018

(54) MICROPHONE ASSEMBLY HAVING AN ACOUSTIC LEAK PATH

(71) Applicant: Apple Inc., Cupertino, CA (US)

(72) Inventors: Nikolas T. Vitt, Sunnyvale, CA (US); Neal D. Evans, Sunnyvale, CA (US); Jesse A. Lippert, Sunnyvale, CA (US); Ruchir M. Dave, San Jose, CA (US); Christopher Wilk, Los Gatos, CA (US); Brad G. Boozer, Saratoga, CA (US); Dennis R. Pyper, San Jose, CA (US); Daniel K. Boothe, San Francisco, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 15/151,445

(22) Filed: May 10, 2016

(65) Prior Publication Data

US 2017/0164084 A1 Jun. 8, 2017

Related U.S. Application Data

(60) Provisional application No. 62/263,460, filed on Dec. 4, 2015.

(51) Int. Cl.
*H04R 1/08* (2006.01)
*H04R 1/22* (2006.01)

(52) U.S. Cl.
CPC ..... *H04R 1/086* (2013.01); *H04R 1/08* (2013.01); *H04R 1/222* (2013.01)

(58) Field of Classification Search
CPC ..... A45C 11/00; B65D 85/30; G06F 1/1656; G10L 21/0208; H04M 1/0249; H04R 1/02; H04R 1/023; H04R 1/1033; H04R 1/086; B81B 3/0051
USPC ..... 381/189, 316, 337, 355, 71.4, 93, 174, 381/302, 312, 323, 356, 369; 455/550.1; 73/584; 257/419
See application file for complete search history.

(56) References Cited

U.S. PATENT DOCUMENTS

| | | | | |
|---|---|---|---|---|
| 4,777,650 | A | 10/1988 | Frederiksen | |
| 5,452,268 | A | 9/1995 | Bernstein | |
| 6,018,585 | A * | 1/2000 | Akino | H04R 1/086 128/201.19 |
| 6,188,773 | B1 | 2/2001 | Murata et al. | |
| 7,415,122 | B2 * | 8/2008 | Soutar | H04R 1/083 381/189 |
| 8,213,660 | B2 * | 7/2012 | Phillips | H04R 1/086 379/433.03 |
| 8,325,958 | B2 | 12/2012 | Rass | |
| 8,494,577 | B2 * | 7/2013 | Shiogama | H04M 1/035 455/550.1 |
| 9,099,094 | B2 * | 8/2015 | Burnett | G10L 21/0208 |
| 9,317,068 | B2 * | 4/2016 | Sanders | G06F 1/1656 |
| 9,348,371 | B2 * | 5/2016 | Hoobler | H04B 1/3888 |

(Continued)

*Primary Examiner* — Gerald Gauthier
(74) *Attorney, Agent, or Firm* — Blakely Sokoloff Taylor & Zafman LLP

(57) ABSTRACT

An electronic device having a microphone behind a water resistant, air-impermeable membrane is disclosed. Embodiments include a trapped volume of air between the membrane and the microphone. A barometric equalization element may define an acoustic leak path, e.g., a tortuous leak path, between the trapped volume of air and an encased space within a casing of the electronic device. Other embodiments are also described and claimed.

22 Claims, 12 Drawing Sheets

(56) References Cited

U.S. PATENT DOCUMENTS 9,408,009 B1 8/2016 Witte et al.
9,469,469 B2 * 10/2016 Rayner ..... G06F 1/1626
9,498,032 B2 * 11/2016 Wu ..... A45C 11/00
9,538,272 B2 * 1/2017 Auclair ..... G10K 11/18
9,560,430 B2 * 1/2017 Iuchi ..... H04R 1/023
9,560,435 B2 * 1/2017 Richardson ..... G06F 1/1626
9,571,910 B2 * 2/2017 Lu ..... H04R 1/02
9,591,110 B2 * 3/2017 Hill ..... H04M 1/0249
2003/0059073 A1 * 3/2003 Bren ..... H04R 25/43 381/312
2005/0084128 A1 * 4/2005 Niederdraenk ..... H04R 1/38 381/356
2008/0095390 A1 * 4/2008 Gebert ..... H04R 25/652 381/323
2009/0097669 A1 * 4/2009 Kamiya ..... G10K 11/178 381/71.4
2009/0097679 A1 * 4/2009 Maeda ..... H04S 3/008 381/302
2009/0158849 A1 * 6/2009 Gregg ..... H04R 29/00 73/584
2010/0040250 A1 * 2/2010 Gebert ..... H04R 25/654 381/316
2013/0271902 A1 10/2013 Lai et al.
2014/0270273 A1 * 9/2014 Muza ..... H04R 19/005 381/174
2014/0339012 A1 11/2014 Richardson et al.
2015/0163572 A1 6/2015 Weiss et al.
2015/0172815 A1 * 6/2015 Park ..... H04R 3/02 381/93
2016/0080871 A1 * 3/2016 Zinn ..... H04R 19/04 381/369
2016/0122177 A1 * 5/2016 Zinn ..... B81B 3/0051 257/419
2017/0164084 A1 * 6/2017 Vitt ..... H04R 1/086
2017/0183218 A1 * 6/2017 Zinn ..... B81B 3/0051

* cited by examiner

A - A

DETAIL A

DETAIL A

MICROPHONE ASSEMBLY HAVING AN ACOUSTIC LEAK PATH

This application claims the benefit of U.S. Provisional Patent Application No. 62/263,460, filed Dec. 4, 2015, and this application hereby incorporates herein by reference that provisional patent application in its entirety.

BACKGROUND

Field

Embodiments related to electronic devices having water resistant acoustic ports and a microphone assembly are disclosed. More particularly, embodiments related to electronic devices having a volume of air trapped between a water resistant membrane and a microphone of a microphone assembly are disclosed.

Background Information

An electronic device, such as a computer and/or mobile device, may be exposed to water, e.g., rain or water in a swimming pool. Water resistant acoustic ports, i.e., acoustic ports covered by water resistant membranes, are used to protect electronic components within such electronic devices from water ingress. In some cases, such membranes may not allow air exchange between an environment surrounding the electronic device and an enclosed volume within the electronic device. Sometimes, such membranes can exchange air, but at a rate that does not prevent air from being trapped within the enclosed volume, as in the case of rapid pressure changes, e.g., in an ascending elevator. More particularly, when a microphone is located in the enclosed volume behind the water resistant membrane, a volume of air may be trapped between the membrane and the microphone (including the interior volume of the microphone component). The trapped air may be vented to the enclosed volume within the electronic device to avoid negatively affecting an acoustic response of the membrane, e.g., to avoid distorting the natural deflection of the membrane when a sound is received through the water resistant acoustic port.

SUMMARY

Although venting air behind a water resistant membrane may avoid negative effects on the acoustic response of the membrane, it can cause other problems. More particularly, a vent used to equalize pressure between a trapped volume of air and an enclosed volume in an electronic device may also provide a path for sound to propagate from the enclosed volume into the trapped volume. Thus, sounds generated within the enclosed volume, e.g., audio generated by a speaker or electrical noise generated by capacitors, may propagate into the trapped volume and distort pick up by a microphone in the trapped volume.

In an embodiment, an electronic device includes a microphone assembly having a trapped volume of air between a water resistant membrane and a microphone. The microphone assembly also includes a barometric equalization element having a channel to vent air from the trapped volume to an encased space within the electronic device. The channel also defines an acoustic leak path that attenuates sound generated within the encased space to prevent the sound from entering the trapped volume of air and distorting the microphone pick up.

In an embodiment, an electronic device includes a casing having a casing wall separating a surrounding environment from an encased space, and the casing wall includes an acoustic port. A water resistant membrane may cover the acoustic port. In an embodiment, the water resistant membrane is impermeable to both water and air. A microphone may be located in the encased space behind the membrane. Thus, a trapped volume of air may be disposed between the membrane and an enclosure wall of the microphone. More particularly, the enclosure wall may be disposed between the trapped volume and the encased space. A barometric equalization element may be incorporated in the microphone assembly to equalize pressure within the trapped volume and the encased space. More particularly, the barometric equalization element may include a channel having an entrance port in fluid communication with the trapped volume and an exit port in fluid communication with the encased space. In an embodiment, the channel defines an acoustic leak path between the trapped volume and the encased space which leaks air between the volumes and attenuates predetermined wavelengths of sound generated within the encased space, e.g., acts essentially as a low-pass acoustic filter.

The barometric equalization element of the electronic device may include a channel having a geometry to attenuate predetermined sound wavelengths, e.g., wavelengths above a desired threshold. For example, the channel may include a length along the acoustic leak path between the entrance port and the exit port, and the channel length may be at least 20 times greater, e.g., at least 100 times greater, than a width of the exit port. The acoustic leak path through the channel may also include a nonlinear path, e.g., a tortuous or circuitous path, to allow the long channel to fit compactly within the electronic device. Accordingly, the channel may include several linear channel segments connected by one or more channel bends arranged along a tortuous path. Alternatively, or additionally, the channel may include one or more curvilinear channel segments arranged along a circuitous path. In an embodiment, the width of the exit port is less than a width of the channel at an intermediate point between the entrance port and the exit port.

The barometric equalization element may be fabricated and structured in numerous manners to provide a channel as described above. For example, the barometric equalization element may be disposed between the membrane and the microphone of the microphone assembly. In an embodiment, the membrane is mounted on the barometric equalization element such that an acoustic passage of the barometric equalization element is aligned with the acoustic port in the casing wall along an axis. The barometric equalization element may have an essentially planar profile, such that the channel extends along a plane oriented transverse to the axis between the trapped volume and the encased space. In an embodiment, the essentially planar barometric equalization element includes a first plate having a groove extending along the acoustic leak path and a second plate mounted on the first plate and covering the groove such that the channel is defined between the second plate and a groove surface of the groove. In another embodiment, the essentially planar barometric equalization element includes an open-cell foam layer having a plurality of interconnected pores within a material matrix such that the channel is defined through the interconnected pores. The barometric equalization element may be constructed from preformed and readily available materials. For example, the barometric equalization element may include a plurality of tubes, e.g., hypotube components that are used in medical needle manufacturing. The tubes may be interconnected by one or more chambers such that the channel extends along the acoustic leak path through respective inner lumens of the tubes and respective cavities of the chambers.

In an embodiment, an electronic device includes several barometric equalization elements arranged to attenuate sound having wavelengths above and below the predetermined threshold. More particularly, the trapped volume may be disposed between the membrane and the enclosure wall of the microphone, and a diaphragm of the microphone may be located in the trapped volume to divide the trapped volume into a front compartment and a rear compartment. That is, the diaphragm may include a front face facing the front compartment of the trapped volume and a rear face facing the rear compartment of the trapped volume. A first barometric equalization element may include a first channel having a first entrance port in fluid communication with the front compartment, and a second barometric equalization element may include a second channel having a second entrance port in fluid communication with the rear compartment. Furthermore, the first channel may define a first acoustic leak path having a nonlinear path, e.g., a tortuous path, between the front compartment and the encased space, and the second channel may define a second acoustic leak path between the rear compartment and the encased space. Thus, in addition to attenuating higher frequencies, low frequency sound entering the trapped volume through the barometric equalization elements may arrive at the front face and the rear face at the same time to cause a noise cancellation effect. Accordingly, distortion of the microphone pick up may be mitigated for both higher and lower frequencies. In addition to mitigating distortion across a wide range of frequencies, preventing leakage of speaker signal into a microphone can realize other benefits. For example, in the case of a telephone call, having a speaker signal leak into a microphone may either degrade the quality of the phone call or prevent the ability to transmit on the microphone and receive on the speaker at the same time. Thus, the embodiments described below may mitigate call degradation and/or improve simultaneous transmit/receive of the microphone and speaker.

The barometric equalization elements may be fabricated and structured in numerous manners to provide channels as described above. For example, the first channel may include a first exit port spaced apart from the first entrance port by a first channel length, and the second channel may include a second exit port spaced apart from the second entrance port by a second channel length equal to the first channel length. Furthermore, the exit ports may be located near each other to receive sound from the encased space at essentially the same location. For example, the first entrance port may be spaced apart from the second entrance port by a first distance, and the first exit port may be spaced apart from the second exit port by a second distance that is less than the first distance. More particularly, the first exit port may be adjacent to the second exit port.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

DETAILED DESCRIPTION

Figure 1:
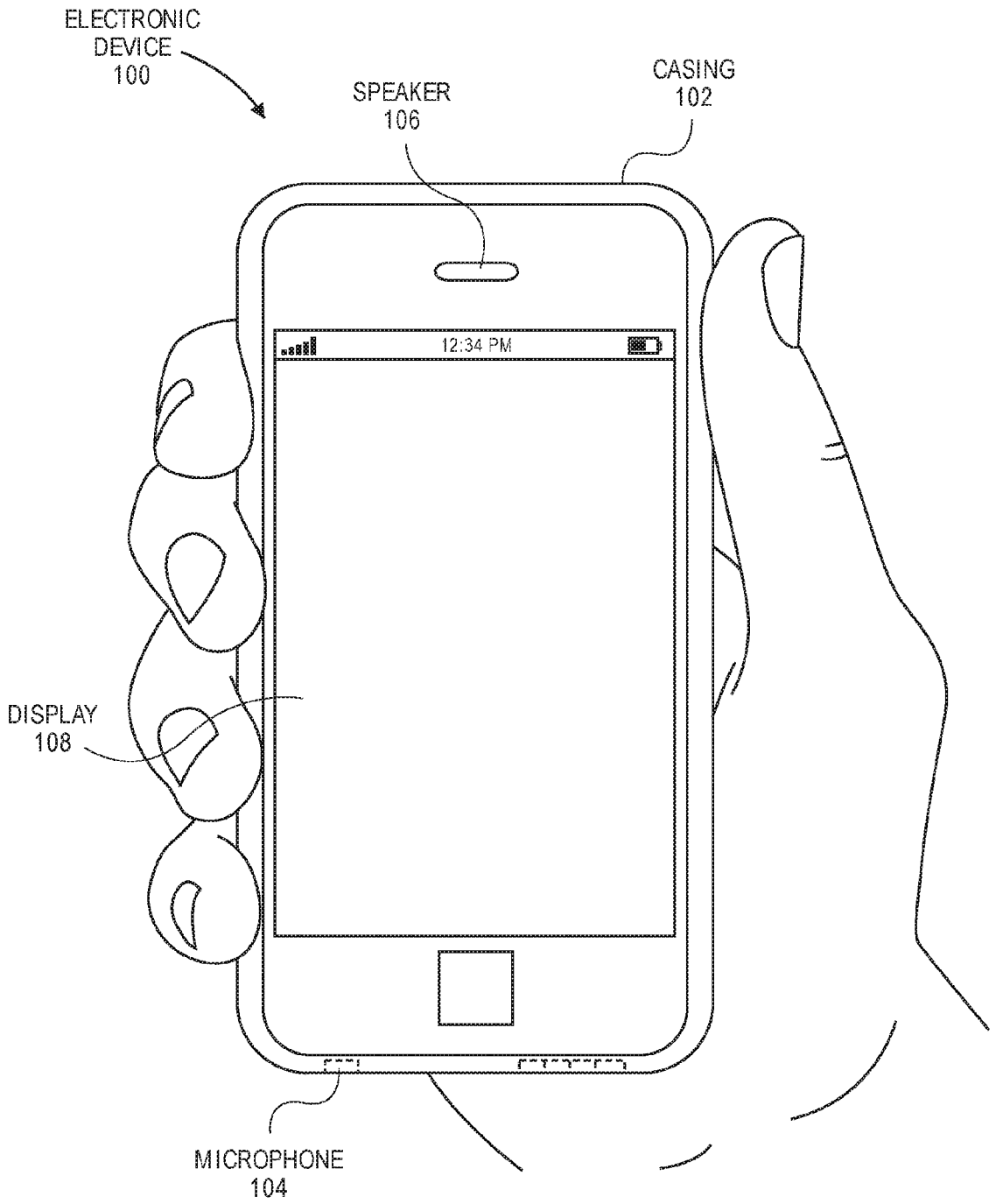
FIG. 1 is a pictorial view of an electronic device in accordance with an embodiment.

Embodiments describe electronic devices and/or electroacoustic transducer components having barometric equalization elements that vent air and attenuate sound having wavelengths in a predetermined range. Some embodiments are described with specific regard to integration within mobile devices such as mobile phones. The embodiments are not so limited, however, and certain embodiments may also be applicable to other uses. For example, a barometric equalization element may be incorporated into other devices and apparatuses, including desktop computers, laptop computers, tablet computers, wearable computers, wristwatch devices, or motor vehicles, to name only a few possible applications.

In various embodiments, description is made with reference to the figures. Certain embodiments, however, may be practiced without one or more of these specific details, or in combination with other known methods and configurations. In the following description, numerous specific details are set forth, such as specific configurations, dimensions, and processes, in order to provide a thorough understanding of the embodiments. In other instances, well-known processes and manufacturing techniques have not been described in particular detail in order to not unnecessarily obscure the description. Reference throughout this specification to "one embodiment," "an embodiment," or the like, means that a particular feature, structure, configuration, or characteristic described is included in at least one embodiment. Thus, the appearance of the phrase "one embodiment," "an embodiment," or the like, in various places throughout this specification are not necessarily referring to the same embodiment. Furthermore, the particular features, structures, configurations, or characteristics may be combined in any suitable manner in one or more embodiments.

The use of relative terms throughout the description, such as "in front of" and "behind" may denote a relative position or direction. For example, an acoustic membrane may be described as being "in front of" a barometric equalization element and "behind" an acoustic port in a casing, opposite from a surrounding environment. Nonetheless, such terms are not intended to limit the use of an acoustic membrane to a specific configuration described in the various embodiments below. For example, an acoustic membrane may be located on the same side of the acoustic port as the surrounding environment.

In an aspect, an electronic device includes a microphone assembly having a barometric equalization element that vents a trapped volume of air from between a water resistant membrane and a microphone to an encased space outside of the microphone assembly. In addition to venting the air to equalize pressure within the device, the barometric equalization element also includes a narrow and long channel that acts as an acoustic low-pass filter. Thus, air can equalize without admitting a predetermined range of audible frequencies to the microphone pick up. In an embodiment, the channel includes an acoustic leak path, e.g., a nonlinear leak path, such as a tortuous path like a maze, between the trapped volume of air and the encased space. The acoustic leak path may be integrally formed in one or more of the microphone assembly components, e.g., in a layer of the barometric equalization element and/or in a printed circuit board (PCB) used to mount the microphone.

Referring to FIG. 1, a pictorial view of an electronic device is shown in accordance with an embodiment. An electronic device 100 may be a smartphone device. Alternatively, it could be any other portable or stationary device or apparatus, such as a laptop computer, a tablet computer, a wearable computer, a wristwatch device, etc. Electronic device 100 may include various capabilities to allow the user to access features involving, for example, calls, voicemail, music, e-mail, internet browsing, scheduling, or photos. Electronic device 100 may also include hardware to facilitate such capabilities. For example, a casing 102 may contain a microphone 104 to pick up the voice of a user during a call, and an audio speaker 106, e.g., a micro speaker, to deliver a far-end voice to the near-end user during the call. Speaker 106 may also emit sounds associated with music files played by a music player application running on electronic device 100. A display 108 may present the user with a graphical user interface to allow the user to interact with electronic device 100 and/or applications running on electronic device 100. Other conventional features are not shown but may of course be included in electronic device 100.

Figure 2:
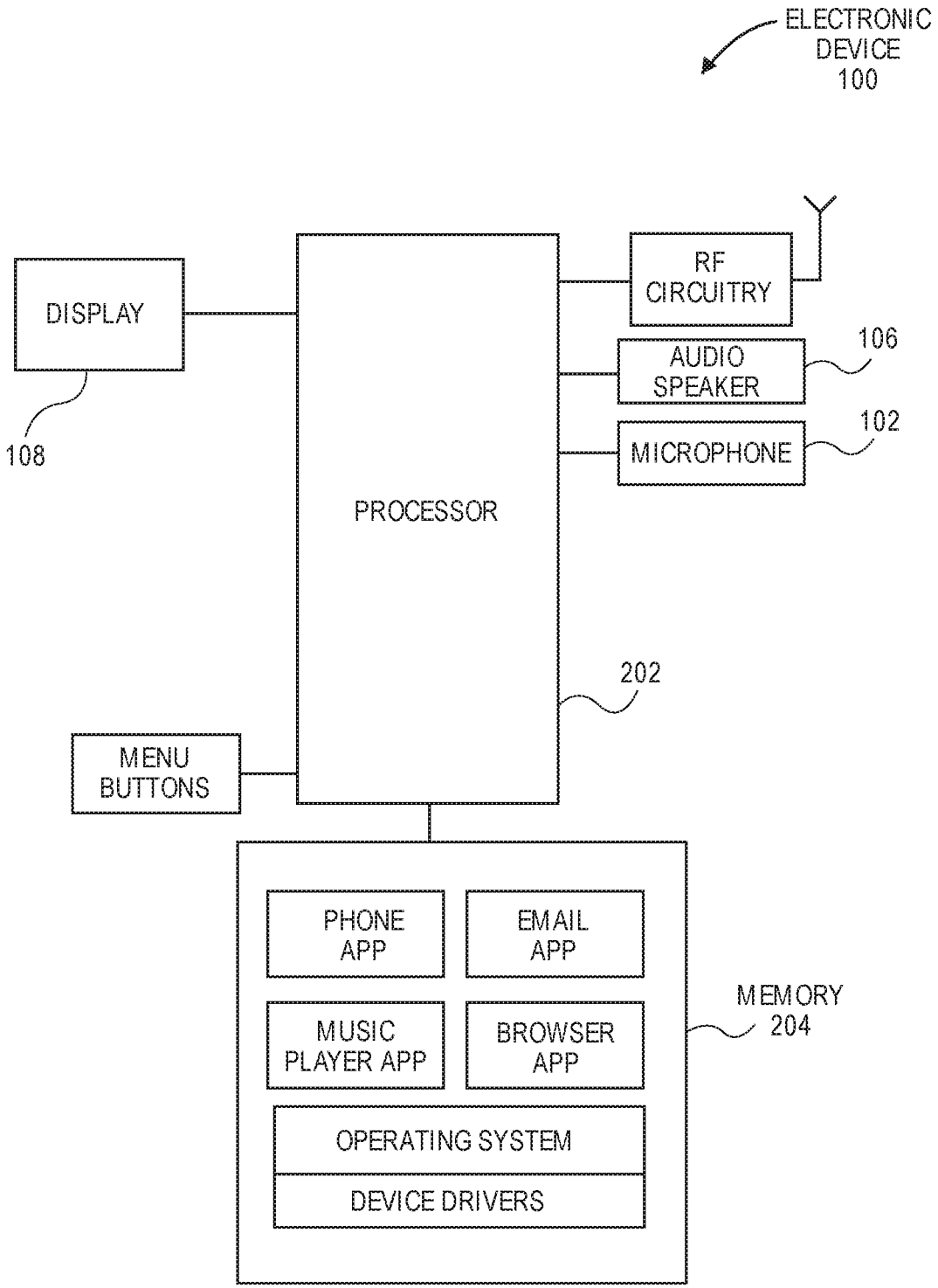
FIG. 2 is a schematic view of an electronic device in accordance with an embodiment.

Referring to FIG. 2, a schematic view of an electronic device is shown in accordance with an embodiment. As described above, electronic device 100 may be one of several types of portable or stationary devices or apparatuses with circuitry suited to specific functionality. Accordingly, the diagrammed circuitry is provided by way of example and not limitation. Electronic device 100 may include one or more processors 202 to execute instructions to carry out the different functions and capabilities described above. Instructions executed by processor(s) 202 of electronic device 100 may be retrieved from a local memory 204, and may be in the form of an operating system program having device drivers, as well as one or more application programs that run on top of the operating system. The instructions may cause electronic device 100 to perform the different functions introduced above, e.g., phone and/or music play back functions. To perform such functions, processor(s) 202 may directly or indirectly implement control loops and receive input signals from and/or provide output signals to other electronic components, such as microphone 104 or speaker 106.

Figure 3:
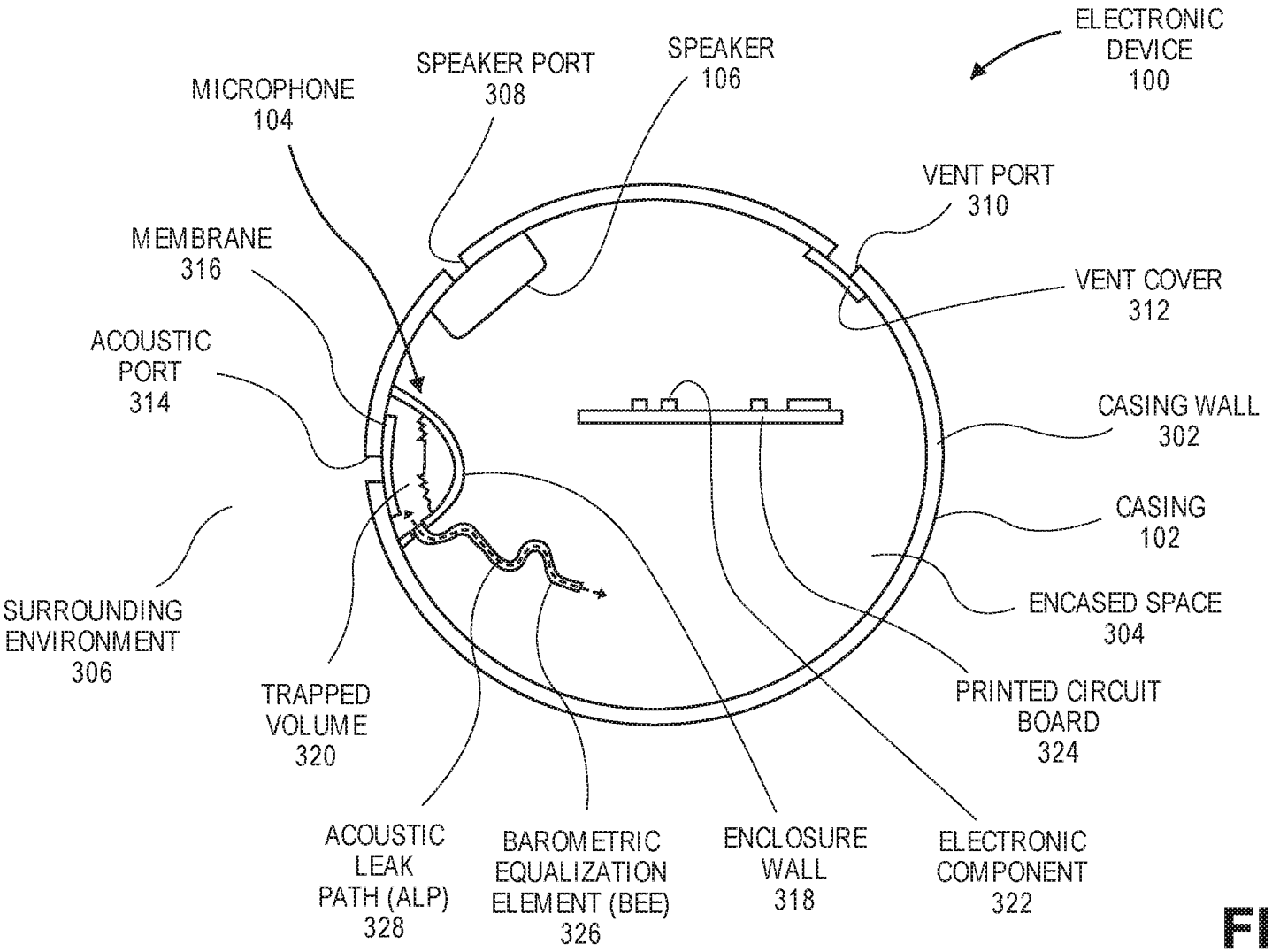
FIG. 3 is a pictorial view of an electronic device in accordance with an embodiment.

Referring to FIG. 3, a pictorial view of an electronic device is shown in accordance with an embodiment. Casing 102 may provide a shell within which the various internal components of electronic device 100 are located. More particularly, casing 102 may include a casing wall 302 having a thickness between an outer surface and an inner surface. Thus, the inner surface of casing wall 302 may surround an encased space 304 to receive the various components of electronic device 100. Furthermore, the outer surface of casing wall 302 may face a surrounding environment 306 and separate surrounding environment 306 from encased space 304.

Electronic device 100 may include one or more ports through casing wall 302 to place the encased space 304 in acoustic communication with surrounding environment 306. For example, speaker 106 may be mounted on the inner surface of casing wall 302 to generate and emit sound outward into surrounding environment 306. Thus, a speaker port 308 may be located in and through casing wall 302 to provide an acoustic pathway between speaker 106 and surrounding environment 306. Similarly, a vent port 310 may be located in and through casing wall 302 to provide a barometric equalization path between encased space 304 and surrounding environment 306. One or more of speaker port 308 and vent port 310 may be covered by a barrier to prevent the ingress of particles and/or water into encased space 304 from surrounding environment 306. For example, electronic device 100 may include a vent cover 312 covering vent port 310, and vent cover 312 may include a mesh or other barrier material to repel incoming particles and/or water.

In addition to having ports for communicating air and/or sound outward from encased space 304 into surrounding environment 306, electronic device 100 may include an acoustic port 314 in and through casing wall 302 to receive sounds from surrounding environment 306. Acoustic port 314 may have a cross-sectional area large enough to admit particulate and/or water from surrounding environment 306, and thus, a water resistant membrane may be used to waterproof electronic device 100. More particularly, a membrane 316 having high water resistance may be used to cover acoustic port 314. Membrane 316 may exhibit high water resistance as a result of having a porosity that resists water ingress. More particularly, membrane 316 may include pores having cross-sectional dimensions that are smaller than a dimension of water molecules. In an embodiment, membrane 316 is also impermeable to air. For example, leakage through membrane 316 may only result from molecular diffusivity. Accordingly, any pores within membrane 316 may have a mean cross-sectional dimension less than the mean free path of air at ambient pressure, e.g., less than 50 nm. Thus, air impermeable channels may inhibit the passage of air across acoustic membrane 316, and reduce the likelihood of gas and water exchange between surrounding environment 306 and encased space 304.

Membrane 316 may be acoustically transparent in addition to being air impermeable. More particularly, membrane 316 may be a reactive membrane that deflects when sound from surrounding environment 306 impinges upon it, and transmits the sound to a space behind membrane 316. In an embodiment, the transmitted sound is directed toward microphone 104 mounted within encased space 304. Thus, microphone 104 and membrane 316 may act in combination to provide a microphone assembly to pick up sound for electronic device 100. That is, the microphone assembly may be mounted on casing 102 behind acoustic port 314 to pick up sound from surrounding environment 306.

Microphone 104 may include an enclosure wall 318 to mount on casing 102 and to separate encased space 304 from a trapped volume 320 of air. More particularly, trapped volume 320 may be a sub-volume of encased space 304 that is disposed between membrane 316 and the enclosure wall 318. Accordingly, enclosure wall 318 may be used as a reference structure situated between trapped volume 320 and encased space 304. Enclosure wall 318 may not merely be referential, however. That is, enclosure wall 318 may be a rigid barrier and as membrane 316 reacts to incoming sound waves, air within trapped volume 320 may compress to generate a pressure difference between trapped volume 320 and encased space 304 on the other side of enclosure wall 318. Accordingly, trapped volume 320 may be vented to encased space 304 to prevent a pressure buildup within trapped volume 320 from affecting an acoustic response of membrane 316.

Equalization of pressure within trapped volume 320 and encased space 304 may be achieved using a barometric equalization element 326. As described below, barometric equalization element 326 may be incorporated in the microphone assembly and may include a passage for leaking air between trapped volume 320 and encased space 304 to equalize the pressures therein. The passage may also provide a route for sound to enter trapped volume 320 from encased space 304.

Electronic device 100 may house noisy components. As described above, speaker 106 may generate sound in encased space 304 and the sound may propagate through barometric equalization element 326 into trapped volume 320 where it could be picked up by microphone 104. Similarly, electronic device 100 may include one or more electronic components 322 mounted on a printed circuit board (PCB) 324 as is known in the art. For example, electronic component 322 may be a capacitor that generates electronic noise, and the noise may propagate through barometric equalization element 326 to trapped volume 320. Thus, as described further below, the passage of barometric equalization element 326 may be designed to provide an acoustic leak path that vents air and also to resist passage of certain wavelengths of sound, i.e., to attenuate frequencies that could negatively affect the microphone pick up. The acoustic leak path may include one or more curves, bends, undulations, etc., between trapped volume 320 and encased space 304. Thus, the acoustic leak path may be an acoustic leak path 328 having a nonlinear path. Furthermore, barometric equalization element 326 may include a passage that is long and narrow, since the nonlinear shape of acoustic leak path 328 can allow a long path to be fit within a compact area.

Figure 4:
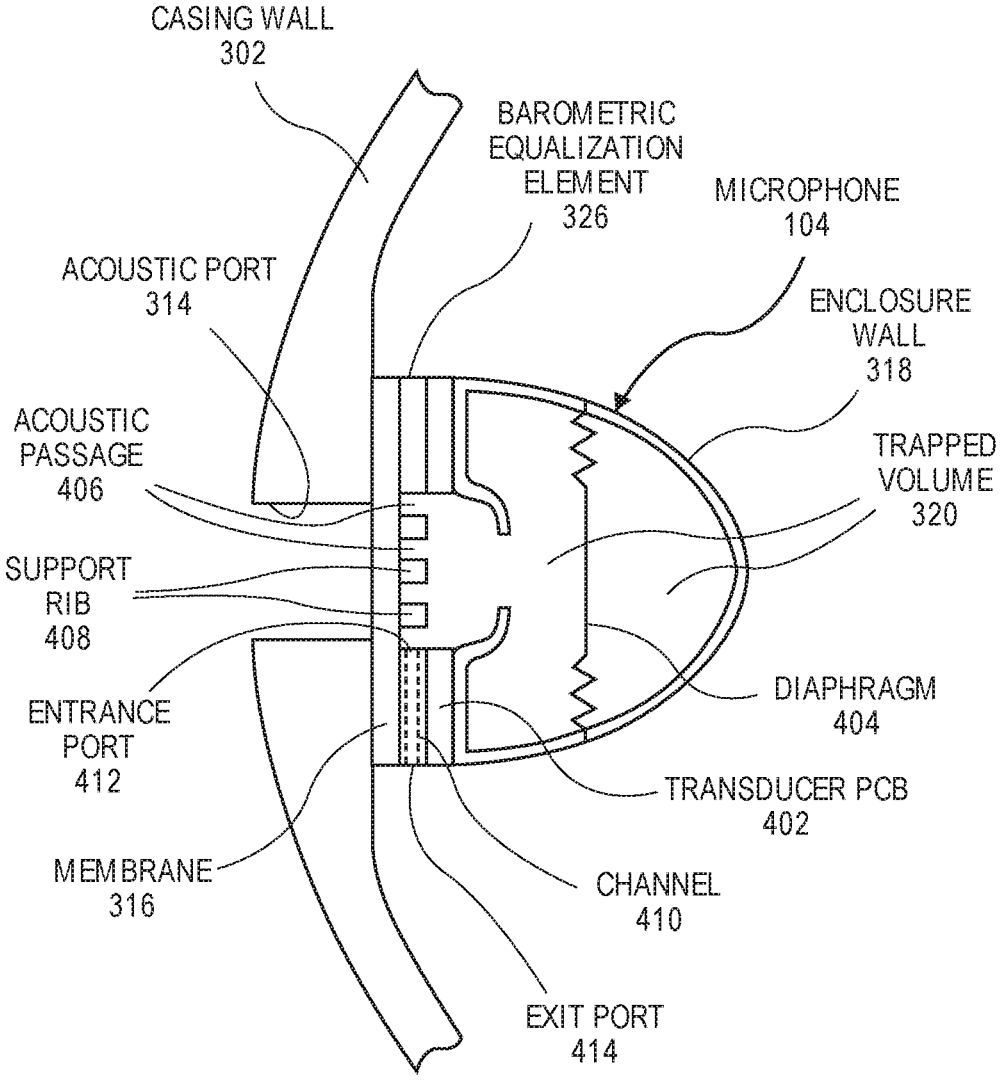
FIG. 4 is a sectional view of a microphone assembly of an electronic device in accordance with an embodiment.

Referring to FIG. 4, a sectional view of a microphone assembly of an electronic device 100 is shown in accordance with an embodiment. The microphone assembly may include microphone 104 mounted on barometric equalization element 326, and barometric equalization element 326 may be mounted on membrane 316. Thus, barometric equalization element 326 may be disposed between membrane 316 and microphone 104. An attachment between these components may be direct or indirect. For example, a rear surface of membrane 316 may interface directly with a front surface of barometric equalization element 326. Alternatively, one or more additional components may be located between these components. For example, microphone 104 may be a MEMS microphone, and thus, enclosure wall 318 of microphone 104 may be mounted on, and electrically connected with, a transducer PCB 402. Transducer PCB 402 may receive electrical audio signals from microphone 104, e.g., when a diaphragm 404 of microphone 104 is moved by pressure variations within trapped volume 320. Accordingly, transducer PCB 402 may be located between barometric equalization element 326 and microphone 104.

In an embodiment, the microphone assembly may be mounted on the inner surface of casing wall 302 and located to receive sound through acoustic port 314 to actuate diaphragm 404 of microphone 104. More particularly, barometric equalization element 326 may include one or more acoustic passage 406 axially aligned with acoustic port 314 such that sound propagating through acoustic port 314 will cause deflection of membrane 316 over acoustic passage 406. Barometric equalization element 326 may include several acoustic passages 406 located between a peripheral region behind casing wall 302 and one or more support ribs 408 behind acoustic port 314. Support ribs 408 may provide a stiffening effect on membrane 316 to limit the deflection of membrane 316, e.g., caused by sound and/or impinging water. This support can prevent damage to membrane 316 caused by deflection beyond a failure point.

Barometric equalization element 326 may include a channel 410 to place trapped volume 320 in fluid communication with encased space 304. More particularly, channel 410 may include an entrance port 412 in fluid communication with trapped volume 320, and an exit port 414 at an opposite end of channel 410 in fluid communication with encased space 304. As used here, the terms "entrance" and "exit" are not intended to be limiting since it is possible for air to pass through channel 410 both from trapped volume 320 to encased space 304, and from encased space 304 to trapped volume 320. More particularly, channel 410 is not necessarily directional.

As described further below, barometric equalization element 326 may include an essentially planar shape, e.g., a thin plate-like shape. In an embodiment, acoustic passage 406 of barometric equalization element 326 is axially aligned with acoustic port 314 (e.g., along an axis running in a left-to-right axial direction in FIG. 4) and extends through a thickness of barometric equalization element 326. Thus, a planar surface of barometric equalization element 326, e.g., a front or rear surface of the element, may be parallel to diaphragm 404. Furthermore, channel 410 may extend along a plane oriented transverse to the axis that acoustic port 314 and acoustic passage 406 are aligned on. More particularly, barometric equalization element 326 may include a passage wall (FIG. 10) extending in a thickness direction between a front and rear surface of barometric equalization element 326. The passage wall may surround acoustic passage 406, and face support ribs 408. Likewise, barometric equalization element 326 may include an outer wall laterally outward from the passage wall and surrounding the body of barometric equalization element 326. Entrance port 412 may be located on the passage wall and exit port 414 may be located on the outer wall, and thus, channel 410 may extend from entrance port 412 to exit port 414 in a transverse direction. Channel 410, which may be long and narrow, may include a variety of geometries described below.

Figure 5:
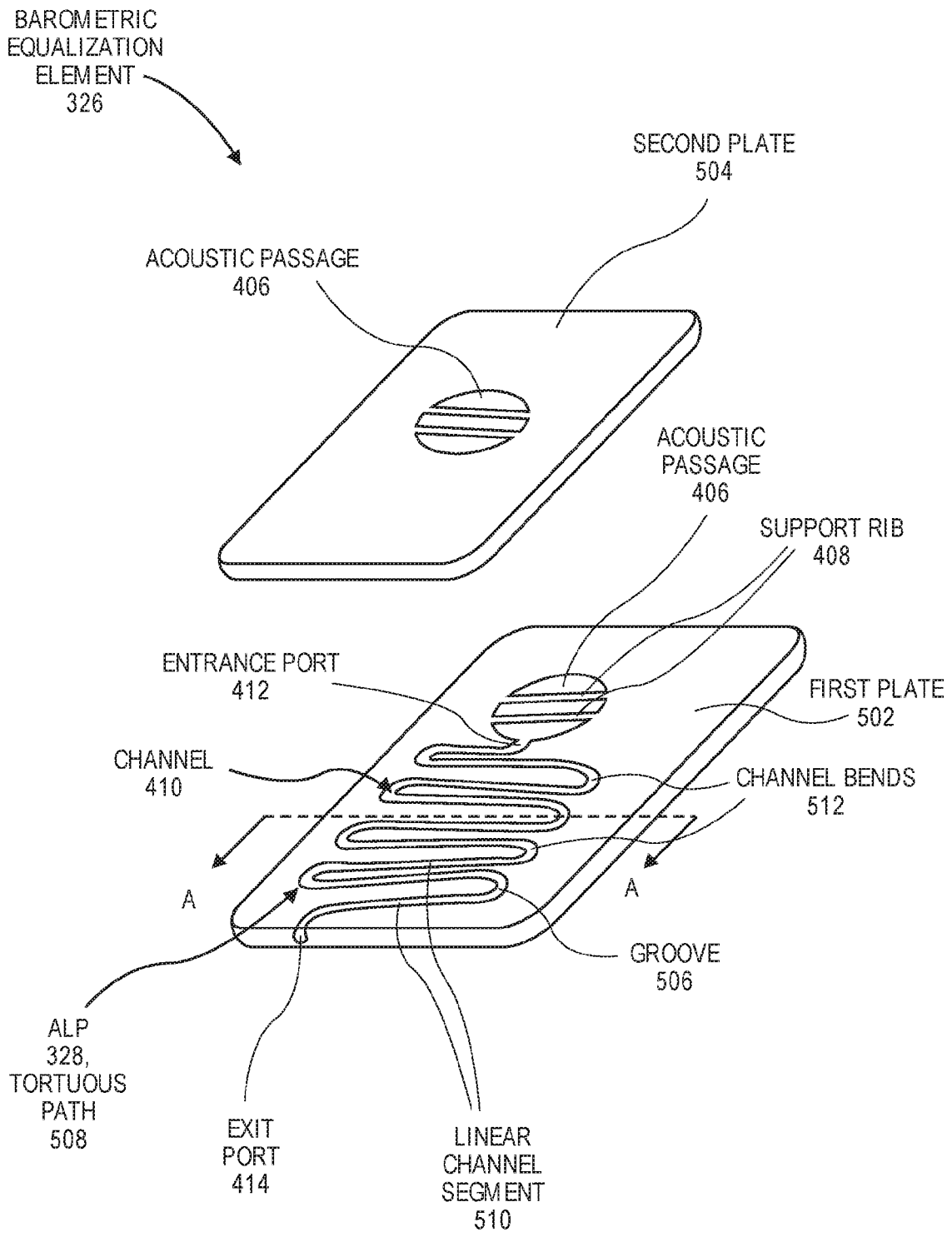
FIG. 5 is an exploded view of a barometric equalization element in accordance with an embodiment.

Referring to FIG. 5, an exploded view of a barometric equalization element is shown in accordance with an embodiment. Barometric equalization element 326 may include a first plate 502 having an upper planar surface separated from a bottom planar surface by a thickness. Acoustic passages 406 may be formed in the thickness direction through a central region of first plate 502 and separated from each other by support ribs 408. Thus, channel 410 may extend along the upper surface from entrance port 412 at acoustic passage 406 to exit port 414 along an outer wall of first plate 502. Accordingly, channel 410 may include a channel length, i.e., the length of acoustic leak path 328 through channel 410 between entrance port 412 and exit port 414.

In an embodiment, channel 410 is formed by a combination of first plate 502 and a second plate 504. For example, a groove 506 may be formed in the upper surface of first plate 502, and second plate 504 may be mounted on first plate 502 to cover groove 506. Accordingly, channel 410 may be defined between a surface of groove 506 recessed below the upper surface of first plate 502 and a lower surface of second plate 504. For example, the lower surface of second plate 504 may be flat and extend over groove 506 to form a cross-sectional area of channel 410. Alternatively, a corresponding groove 506 may be formed in the lower surface of second plate 504 to mate with groove 506 in first plate 502 and form a cross-sectional area of channel 410. By way of example, when both grooves 506 are semi-circular the combination of grooves 506 forms channel 410 having a circular cross-sectional area.

An essentially planar barometric equalization element 326 may be formed in numerous ways. In an embodiment, first plate 502 and second plate 504 are fabricated from a sheet of material, e.g., stainless steel sheet metal may be cut into the desired plate shape. Subsequently, one or both of first plate 502 and second plate 504 may be masked to prepare the plate blank for an etching process to form groove 506 on an upper or lower surface. Alternatively, groove 506 may be formed in one or both of the plates using known micromachining processes, e.g., using an electrical discharge machining process. Acoustic passage 406 may be formed though the plates using known machining processes, such as laser cutting, or via chemical etching processes. Acoustic passage 406 may have an identical profile in first plate 502 and second plate 504 (FIG. 5) or one plate may include acoustic passages 406 that are framed by support ribs 408 and another plate may include an acoustic passage 406 without support ribs 408, e.g., a circular hole. After fabricating grooves 506 within the plates, the corresponding sides of the plates, i.e., the upper surface of first plate 502 and/or the lower surface of second plate 504 may be tinned and pressed together to join the plates. That is, first plate 502 having groove 506 may be attached to second plate 504 and the combined surfaces of the plates may form channel 410.

Still referring to FIG. 5, acoustic leak path 328 may include a tortuous path 508 between entrance port 412 and exit port 414. A tortuous path 508, i.e., a path with several bends, curves, switchbacks, etc., allows for a maximum channel length to be achieved within a given area. As a straightforward example, when channel 410 extends along a straight path from entrance port 412 at acoustic passage 406 to exit port 414 at an outer wall of first plate 502, the channel length would be approximately half of a planar length of first plate 502. When channel 410 extends along tortuous path 508, however, the channel length can be many times longer than the planar length of first plate 502.

In an embodiment, channel 410 includes several linear channel segments 510 connected by one or more channel bends 512. More particularly, linear channel segment 510 may extend along a straight segment of tortuous path 508, and channel bends 512 may extend along an angular or curved segment of tortuous path 508 that connects two straight segments. Accordingly, tortuous path 508 may be a serpentine path (in the case of channel bends 512 extending along radial curves), a zig-zag path (in the case of channel bends 512 extending along angular bends), or another undulating or meandering path having several reversals of direction between entrance port 412 and exit port 414. Thus, tortuous path 508 is longer than a straight line between the ports.

Figure 6:
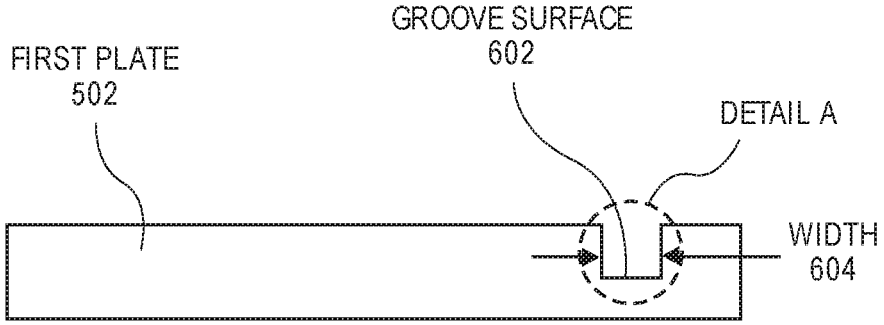
FIG. 6 is a sectional view, taken about line A-A of FIG. 5, of a first plate of a barometric equalization element in accordance with an embodiment.

Referring to FIG. 6, a sectional view, taken about line A-A of FIG. 5, of a first plate of a barometric equalization element is shown in accordance with an embodiment. The channel length at which entrance port 412 is spaced apart from exit port 414 along acoustic leak path 328, may have a predetermined relationship relative to a cross-sectional dimension of channel 410. For example, the channel length may be substantially greater than a dimension measured between opposing sides of a groove surface 602 of groove 506 formed in first plate 502. In an embodiment, the channel length is at least 20 times greater than a width 604 across channel 410 between opposing groove surfaces 602. The channel length may be at least 100 times greater than width 604, e.g., at least 1000 times greater than width 604. In addition to having a relationship between the channel length and a cross-sectional dimension of channel 410, the cross-sectional dimension may be constrained to be less than a predetermined dimension. For example, width 604 may be less than 50 micron, e.g., less than 40 micron. By way of example, rectangular channel 410 shown in FIG. 6 may have width 604 and/or a height of 35 microns. The channel length between entrance port 412 and exit port 414 along tortuous path 508, however, may be 1000 times width 604, i.e., 35 millimeters in this example.

As described below, a cross-section of channel 410 may be uniform or non-uniform. For example, channel 410 may have a same width 604 at entrance port 412, exit port 414, and every point between the ports. Alternatively, channel 410 may have a different width 604 at entrance port 412, exit port 414, and/or one or more intermediate points between the ports. In an embodiment, the relationship between the channel length and the channel 410 cross-sectional dimension may be specific to exit port 414. For example, the channel length may be at least 20 times, e.g., 100 to upwards of 1000 times, greater than width 604 located at exit port 414.

Figure 7A:
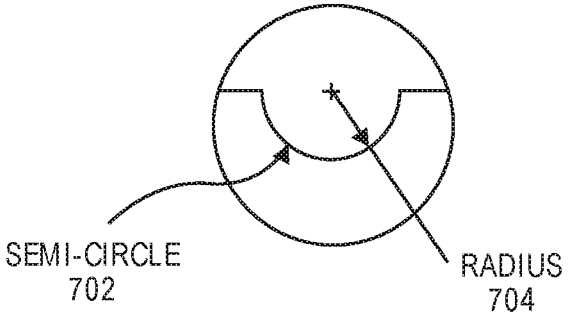
FIGS. 7A-7B are detail views, taken from Detail A of FIG. 6, of a channel of a barometric equalization element in accordance with an embodiment.

Referring to FIG. 7A, a detail view, taken from Detail A of FIG. 6, of a channel of a barometric equalization element is shown in accordance with an embodiment. The cross-sectional area of channel 410 may vary. For example, rather than being composed of flat surfaces, groove 506 formed in first plate 502 may be curved, e.g., a cross-section of groove surface 602 may include a semi-circle 702, such that a cross-sectional dimension across channel 410 is a diameter, i.e., twice a radius 704 of the semi-circle 702. Thus, channel 410 may have a semi-circular or an elliptical cross-section and the channel length may be at least 20 times greater than the diameter.

Figure 7B:
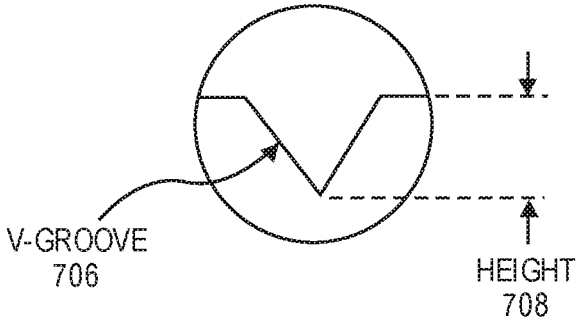

Referring to FIG. 7B, a detail view, taken from Detail A of FIG. 6, of a channel of a barometric equalization element is shown in accordance with another embodiment. In an embodiment, groove 506 may include a v-groove 706, such that a cross-sectional dimension across channel 410 is a height 708. Thus, the channel length may be at least 20 times greater than the height 708.

Figure 8:
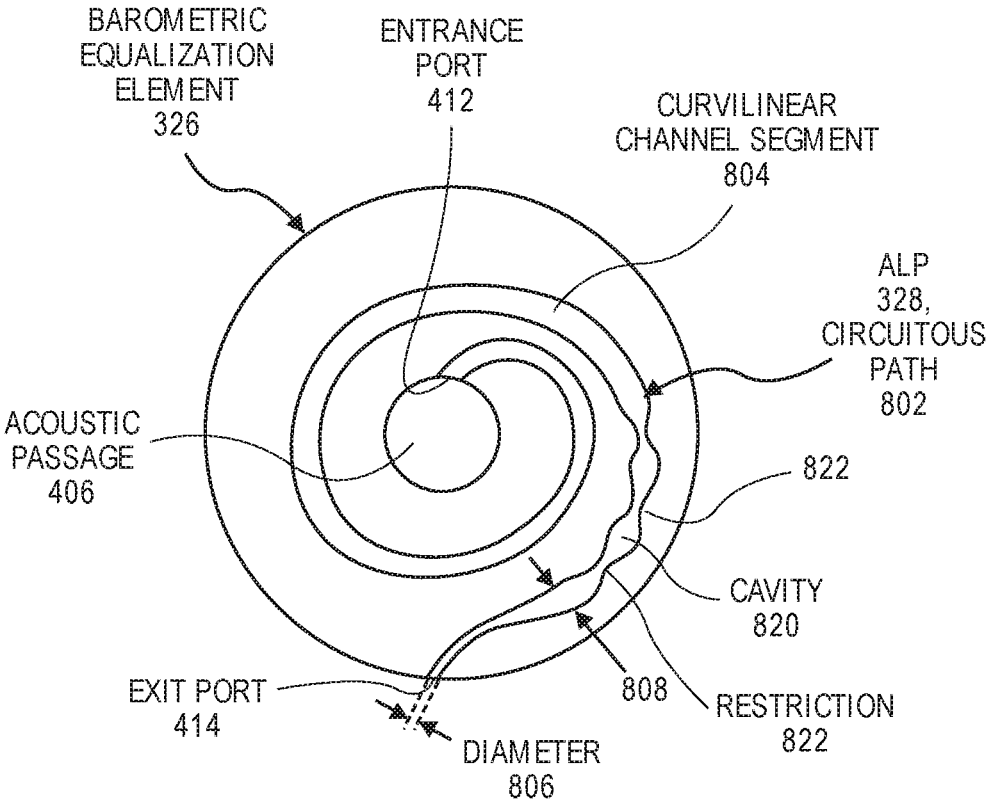
FIG. 8 is a sectional view of a barometric equalization element in accordance with an embodiment.

Referring to FIG. 8, a sectional view of a barometric equalization element is shown in accordance with an embodiment. In an embodiment, channel 410 defines acoustic leak path 328 that includes a circuitous path 802. A circuitous path 802 may be a path that extends in a curved manner along a winding course without reversing direction. Thus, channel 410 may include a curvilinear channel segment 804 extending from entrance port 412 at acoustic passage 406 and winding outward around acoustic passage 406 to exit port 414 at the outer wall of barometric equalization element 326. Channel 410 may include a single curvilinear channel segment 804 arranged in a spiral fashion between the ports, or several curvilinear channel segments 804 may be interconnected, e.g., by bends or straight segments as the channel 410 extends along the circuitous path 802.

As described above, a cross-sectional dimension of channel 410 may vary along acoustic leak path 328. For example, exit port 414 may include a diameter 806 that differs from a channel width 808 at a location of channel 410 between entrance port 412 and exit port 414. In an embodiment, variations in cross-sectional dimensions of channel 410 may occur gradually, e.g., channel 410 may taper smoothly from the location having channel width 808 to exit port 414 having diameter 806.

Still referring to FIG. 8, variations in the cross-sectional dimension of channel 410 may also be used to create one or more cavities 820 separated by one or more restrictions 822. Cavities 820 may be regions along channel 410 having a first, larger dimension, and restrictions 822 may be regions along channel 410 having a second, smaller dimension. In the case of channel 410 forming a circular lumen through barometric equalization element 326, cavities 820 may have larger diameters than restrictions 822. Furthermore, diameters may vary from cavity to cavity, and from restriction to restriction. Accordingly, channel 410 may include a continuous, smooth wall between entrance port 412 and exit port 414 that transitions from larger to smaller dimensions to define cavities 820 and restrictions 822 with various spatial volumes. Channel 410 having a varying diameter may be fabricated using known shaping processes, e.g., chemical etching. Accordingly, cavities 820 may be placed along channel 410 to tune channel 410 in a predetermined manner to create a desired frequency response. For example, cavities 820 may act as springs to lower the cut-off frequency of the low-pass filter.

Figure 9:
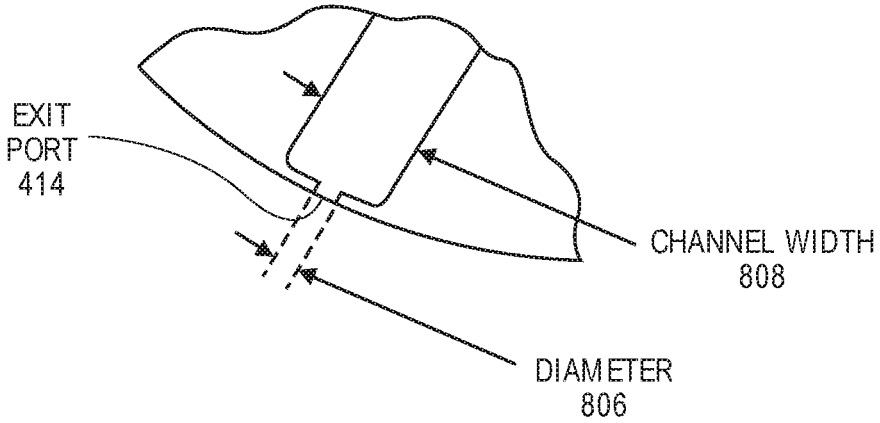
FIG. 9 is a detail view of an exit port of a barometric equalization element in accordance with an embodiment.

Referring to FIG. 9, a detail view of an exit port of a barometric equalization element is shown in accordance with an embodiment. Changes in cross-sectional dimensions of channel 410 at different locations may occur abruptly. In an embodiment, a width of exit port 414 is less than channel width 808 of channel 410 at an intermediate point between entrance port 412 and exit port 414. For example, channel 410 may have channel width 808 at a location adjacent to exit port 414, and channel 410 may be shaped to have an abrupt restriction in cross-sectional area to reduce channel width 808 to diameter 806 at exit port 414. Thus, a portion of channel 410, i.e., the portion having a larger channel width 808, may include a cross-sectional dimension that is greater than 1/20 of the channel length and another portion of channel 410, i.e., exit port 414, may include a cross-sectional dimension that is less than 1/20 of the channel length.

Figure 10:
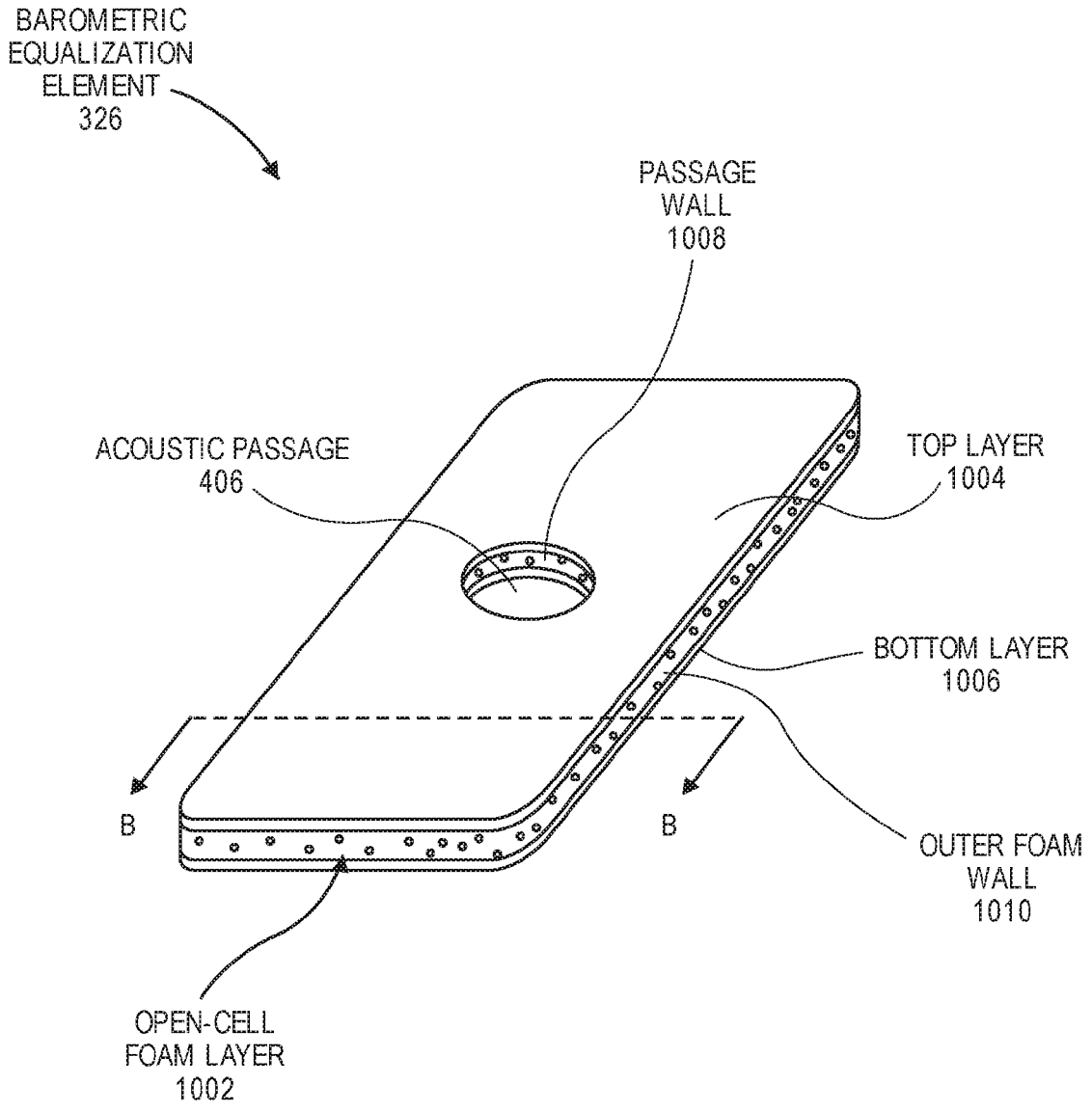
FIG. 10 is a perspective view of a barometric equalization element in accordance with an embodiment.

Referring to FIG. 10, a perspective view of a barometric equalization element is shown in accordance with an embodiment. Barometric equalization element 326 may include an essentially planar shape having one or more open-cell foam layer 1002. Barometric equalization element 326 may include acoustic passage 406 located in a central region to be aligned with acoustic port 314. Acoustic passage 406 is shown without support ribs 408, however, support ribs 408 may be incorporated in barometric equalization element 326 as described above.

In an embodiment, open-cell foam layer 1002 may be laminated with a top layer 1004 and a bottom layer 1006 that sandwich open-cell foam layer 1002 to form a plate-like structure. As such, top layer 1004 may include a flat upper surface that may be mounted on membrane 316, and bottom layer 1006 may include a flat bottom surface that may be mounted on microphone 104. A material of top layer 1004 and bottom layer 1006 may be selected to facilitate such mounting and/or attachment between the microphone assembly components. Top layer 1004 and bottom layer 1006 may also be formed from a material that is impermeable to air. Air within acoustic passage 406 may therefore be vented through open-cell foam layer 1002 between top layer 1004 and bottom layer 1006. More particularly, air may be vented from a passage wall 1008 of open-cell foam layer 1002 facing acoustic passage 406 to an outer foam wall 1010 laterally outward from passage wall 1008 (and surrounding open-cell foam layer 1002) without passing through top layer 1004 or bottom layer 1006. Thus, air may vent from trapped volume 320 through channel 410 formed in open-cell foam layer 1002 to encased space 304.

Figure 11:
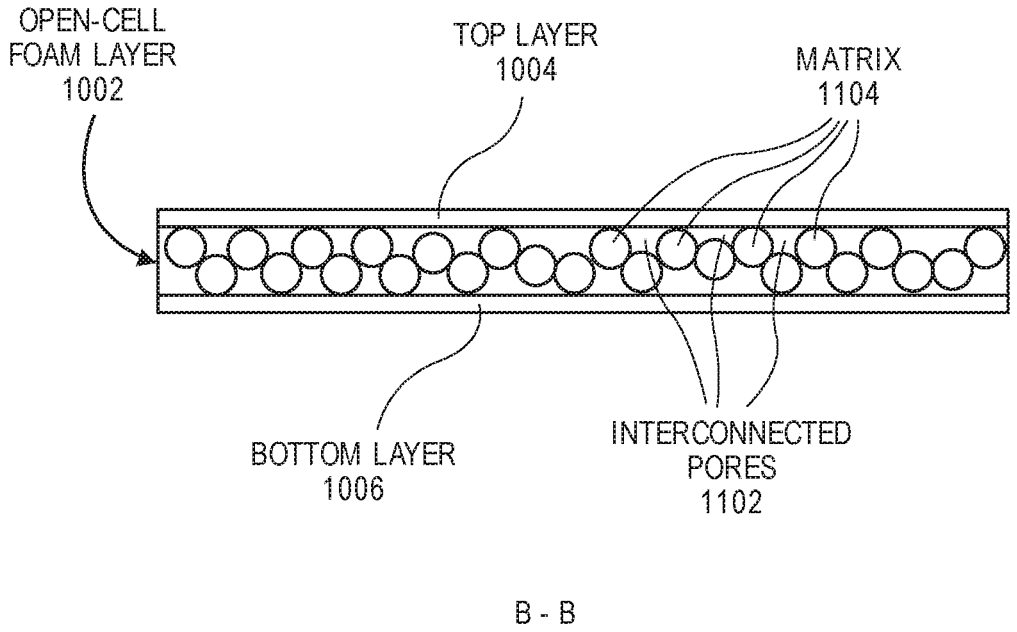
FIG. 11 is a sectional view, taken about line B-B of FIG. 10, of a barometric equalization element in accordance with an embodiment.

Referring to FIG. 11, a sectional view, taken about line B-B of FIG. 10, of a barometric equalization element is shown in accordance with an embodiment. Channel 410 may be defined within interconnected pores 1102 of open-cell foam layer 1002. More particularly, open-cell foam layer 1002 may include an open-cell foam that has a matrix 1104 of foam material surrounding or encapsulating several interconnected pores 1102. Such structure is known in the art for open-cell foams. A porosity of matrix 1104 may be varied during manufacturing. For example, an amount of compression of the foam material may be controlled to fabricate open-cell foam layer 1002 having interconnected pores 1102 of a predetermined average diameter. The average diameter of interconnected pores 1102 may be controlled to be less than a predetermined threshold, e.g., less than 40 micron. Similarly, interconnected pores 1102 may provide a continuous channel 410 of air through open-cell foam layer 1002 and a length of the continuous channel 410 may have a predetermined ratio to the average diameter of interconnected pores 1102. For example, the length of the continuous channel 410 may be at least 20 times greater than the average diameter of interconnected pores 1102.

Figure 12:
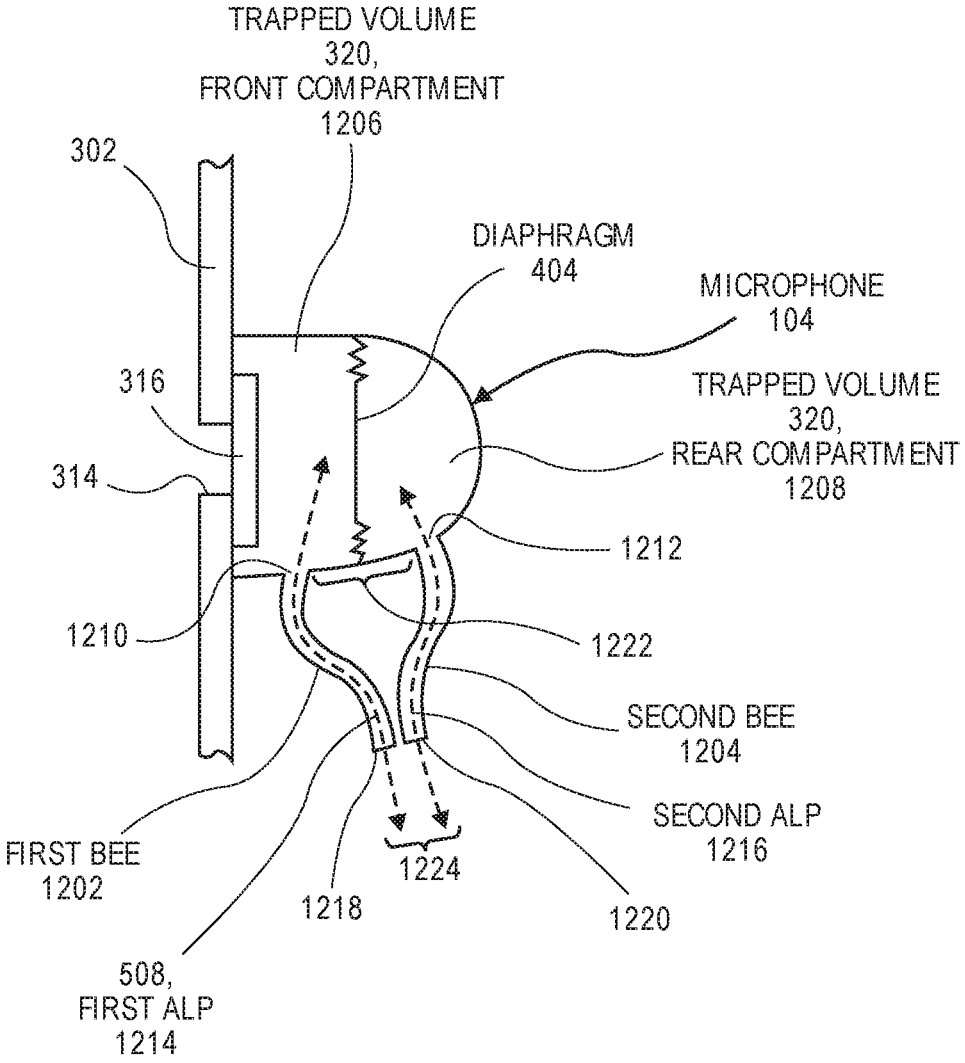
FIG. 12 is a pictorial sectional view of a microphone assembly of an electronic device in accordance with an embodiment.

Referring to FIG. 12, a pictorial sectional view of a microphone assembly of an electronic device is shown in accordance with an embodiment. A microphone assembly of electronic device 100 may include a first barometric equalization element 1202, which can have a structure similar to barometric equalization element 326 discussed above. Thus, first barometric equalization element 1202 may vent air from trapped volume 320 and may attenuate audio frequencies above a predetermined threshold that could otherwise enter trapped volume 320 from encased space 304 and distort microphone pick up. In an embodiment, a second barometric equalization element 1204 is incorporated in the microphone assembly to provide a noise cancellation effect that prevents audio frequencies below the predetermined threshold from distorting microphone pick up when they enter trapped volume 320 from encased space 304.

The microphone assembly that reduces an impact of audio frequencies above and below the predetermined threshold on microphone pick up may include several components that are similar to those described above. For example, electronic device 100 may include a casing wall 302 having acoustic port 314, and the microphone assembly may include microphone 104 and membrane 316. The air impermeable membrane 316 may be mounted on casing wall 302 to cover and waterproof acoustic port 314. Furthermore, as discussed above, microphone 104 may include diaphragm 404 in trapped volume 320 that moves according to pressure variations to pick up sound. Thus, diaphragm 404 may divide trapped volume 320 into several compartments. That is, a portion of trapped volume 320 in front of diaphragm 404 and between membrane 316 and diaphragm 404 may be referred to as a front compartment 1206, and a portion of trapped volume 320 behind diaphragm 404 and between diaphragm 404 and enclosure wall 318 may be referred to as a rear compartment 1208.

In an embodiment, first barometric equalization element 1202 and second barometric equalization element 1204 are in fluid communication with respective compartments of trapped volume 320. For example, first barometric equalization element 1202 may include a first channel having a first entrance port 1210 in fluid communication with front compartment 1206. Similarly, second barometric equalization elements 1204 may include a second channel having a second entrance port 1212 in fluid communication with rear compartment 1208. As described above, a first channel may extend along a first acoustic leak path 1214, e.g., a first nonlinear acoustic leak path, between front compartment 1206 and encased space 304, and the second channel may extend along a second acoustic leak path 1216, e.g., a second nonlinear acoustic leak path, between the rear compartment 1208 and encased space 304. At least one of first acoustic leak path 1214 or second acoustic leak path 1216 may also include tortuous path 508 and/or circuitous path 802, as described above, between a respective compartment of trapped volume 320 and encased space 304. Thus, one or more of first barometric equalization element 1202 or second barometric equalization element 1204 may vent air and attenuate audio frequencies above a predetermined threshold.

First barometric equalization element 1202 and second barometric equalization element 1204 may each provide pathways for low-frequency sound to propagate from encased space 304 into trapped volume 320. In an embodiment, to reduce the likelihood that such sound propagation may negatively impact microphone pick up, an acoustic resistance of first barometric equalization element 1202 and second barometric equalization element 1204 may be controlled such that sound waves of the same frequency that enter the first channel and the second channel at the same time also exit and impinge upon diaphragm 404 at the same time, albeit on opposite sides of diaphragm 404.

Acoustic resistance of the barometric equalization elements 326 may be matched in a number of ways. In an embodiment, the first channel includes a first exit port 1218 spaced apart from first entrance port 1210 by a first channel length, and the second channel includes a second exit port 1220 spaced apart from the second entrance port 1212 by a second channel length. The first channel length and the second channel length may be equal to provide an equivalent path length for sound entering each channel to reach diaphragm 404. Similarly, a cross-sectional dimension of the first and second channels may be equal at corresponding locations along the acoustic leak paths 1214, 1216. Also, the nonlinear acoustic leak paths of the first and second channels may be identical and/or similar, e.g., mirror images of each other, to make the respective acoustic resistances of the barometric equalization elements 326 the same.

The noise cancellation effect may also be facilitated by locating first exit port 1218 adjacent to second exit port 1220 such that essentially the same sound waves from encased space 304 enter both barometric equalization elements at the same location and/or time. For example, a distance between first exit port 1218 and second exit port 1220 may be less than a predetermined threshold. In an embodiment, the threshold is a distance that provides better than ¼ wavelength spacing below 15 kHz. Thus, the first exit port 1218 may be separated from second exit port 1220 by a distance less than 6 mm, e.g., less than 1 mm.

In an embodiment, the exit ports 1218, 1220 of the barometric equalization elements 1202, 1204 may be nearer to each other than the entrance ports 1210, 1212 of the elements. Therefore, in addition to receiving sounds from encased space 304 at approximately the same location, the barometric equalization elements may emit the sounds into the respective compartments at different locations that direct the sounds toward diaphragm 404. Accordingly, the first entrance port 1210 may be spaced apart from the second entrance port 1212 by a first distance 1222, and the first exit port 1218 may be spaced apart from the second exit port 1220 by a smaller second distance 1224. That is, first distance 1222 may be greater than second distance 1224.

Figure 13:
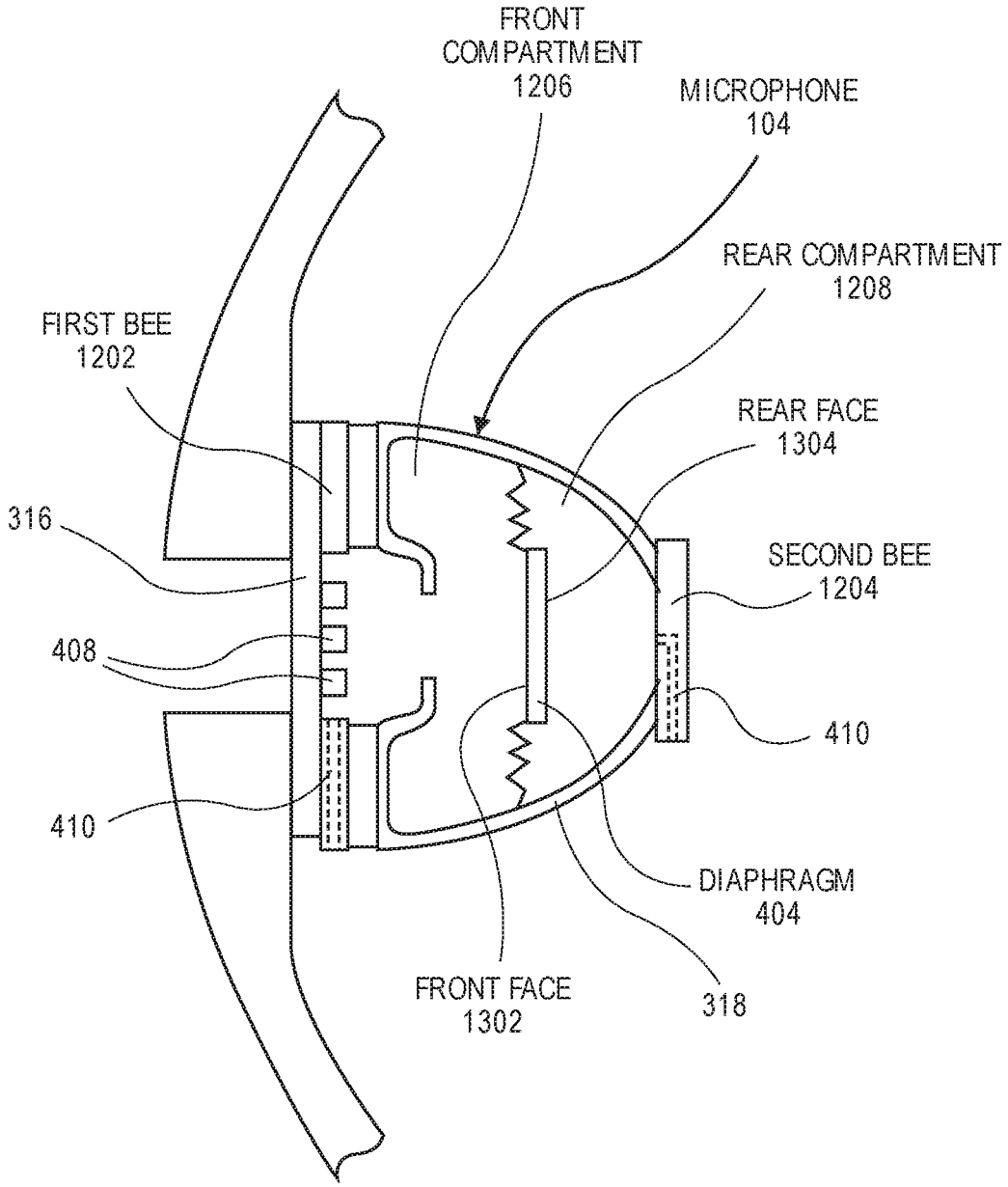
FIG. 13 is a sectional view of a microphone assembly of an electronic device in accordance with an embodiment.

Referring to FIG. 13, a sectional view of a microphone assembly of an electronic device is shown in accordance with an embodiment. The microphone assembly, having first barometric equalization element 1202 and second barometric equalization element 1204 to provide a noise cancellation effect, may also include diaphragm 404 separating front compartment 1206 from rear compartment 1208. Diaphragm 404 may extend laterally between internal sides of enclosure wall 318 and be suspended within trapped volume 320 by a surround element. Furthermore, diaphragm 404 may have a thickness, and thus, a front face 1302 of diaphragm 404 may face front compartment 1206, and a rear face 1304 of diaphragm 404 may face rear compartment 1208. First barometric equalization element 1202 and second barometric equalization element 1204 may incorporate any of the elements features described above. For example, first barometric equalization element 1202 may be located behind membrane 316 and may include support ribs 408 to alter an effective stiffness of membrane 316 and limit membrane movement. Second barometric equalization element 1204, however, may be mounted on enclosure wall 318 behind diaphragm 404, and thus, may not include support ribs 408 or acoustic passage 406. Each barometric equalization element may nonetheless include a respective channel 410, i.e., the first channel and the second channel. As shown, the exit ports of the channels 410 may be separated by a same distance as the entrance ports of the channels 410. Nonetheless, a length of the channels 410 may be the same to provide an equivalent sound path length for noise cancellation.

Several embodiments of barometric equalization element 326 structures are described above (FIG. 5 and FIG. 10). One skilled in the art and equipped with this description would be able to derive other embodiments within the scope of the invention. For example, channel 410 may be incorporated in other components of the microphone assembly to vent air between trapped volume 320 and encased space 304. By way of example, groove 506 may be formed in a front surface of transducer PCB 402 shown in FIG. 4, and transducer PCB 402 may be mounted directly on membrane 316 to allow for the elimination of a separate barometric equalization element plate-like component. More particularly, air may be vented through channel 410 formed between a rear surface of membrane 316 and a groove surface 602 formed in transducer PCB 402. The channel 410 may also attenuate sound as described below.

Figure 14:
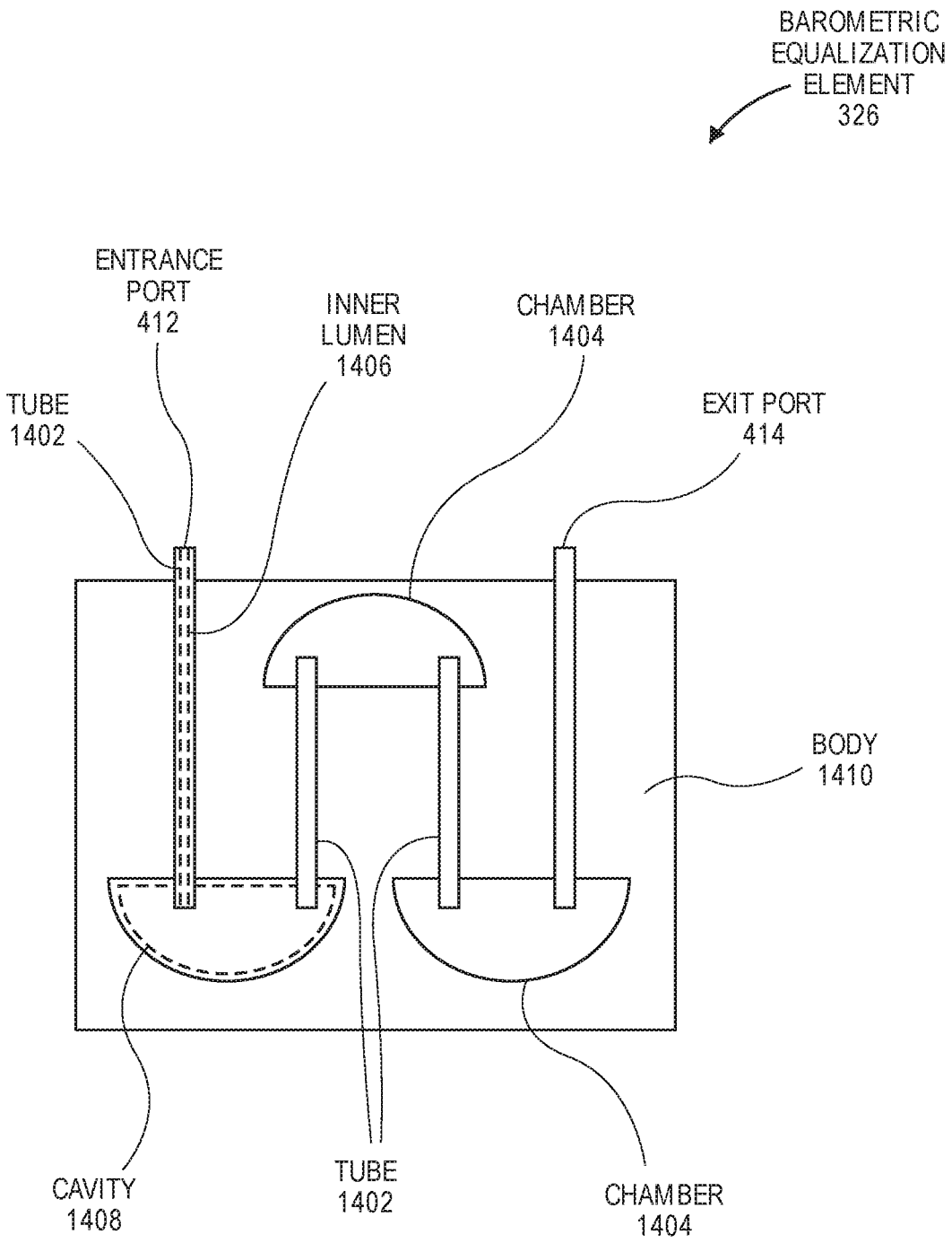
FIG. 14 is a pictorial view of a barometric equalization element in accordance with an embodiment.

Referring to FIG. 14, a pictorial view of a barometric equalization element is shown in accordance with an embodiment. Barometric equalization element 326 may be fabricated using readily available and low cost components. For example, barometric equalization element 326 may include several preformed tubes 1402, e.g., stainless steel hypotubes that are mass-produced for the medical industry, interconnected by one or more chambers 1404. Each tube 1402 may include an inner lumen 1406 and, since tube 1402 may be straight, inner lumen 1406 may provide a linear channel segment 510 of channel 410. Each chamber 1404 may include a cavity 1408 and, since cavity 1408 may provide an air path between non-coaxial inner lumens 1406, cavity 1408 may provide a channel bend 512 of channel 410. Thus, a series of parallel tubes 1402 may be interconnected by several chambers 1404 to provide a tortuous air path from entrance port 412 to exit port 414 that includes narrow segments (inner lumens 1406) and wide segments (cavities 1408). More particularly, channel 410 may extend along acoustic leak path 328 through inner lumens 1406 of tubes 1402 and cavities 1408 of chambers 1404.

In an embodiment, barometric equalization element 326 having tubes 1402 and chambers 1404 may be formed using an injection molding process. For example, preformed tubes 1402 may be loaded into an injection mold as mold inserts, and aligned with chamber 1404 inserts. A body 1410, e.g., a polymer block, may be injection molded around the inserts to fix the components relative to each other and to hermetically seal the joints at which the tubes 1402 and chambers 1404 meet.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. An electronic device, comprising:

a casing having a casing wall separating a surrounding environment from an encased space, wherein the casing wall includes an acoustic port;

a membrane covering the acoustic port, wherein the membrane is impermeable to air;

a microphone in the encased space, wherein the microphone has an enclosure wall mounted on the casing wall, wherein a trapped volume is disposed between the membrane and the enclosure wall, and wherein the enclosure wall is disposed between the trapped volume and the encased space; and a barometric equalization element including a channel having an entrance port in fluid communication with the trapped volume and an exit port in fluid communication with the encased space, wherein the channel defines an acoustic leak path between the trapped volume and the encased space.

2. The electronic device of claim 1, wherein the entrance port is spaced apart from the exit port by a channel length along the acoustic leak path, and wherein the channel length is at least 20 times greater than a width of the exit port.

3. The electronic device of claim 2, wherein the channel length is at least 100 times greater than the width of the exit port.

4. The electronic device of claim 3, wherein the acoustic leak path includes a tortuous path between the entrance port and the exit port.

5. The electronic device of claim 4, wherein the channel includes a plurality of linear channel segments connected by one or more channel bends along the tortuous path.

6. The electronic device of claim 3, wherein the channel includes one or more curvilinear channel segments.

7. The electronic device of claim 3, wherein the width of the exit port is less than a channel width of the channel at an intermediate point between the entrance port and the exit port.

8. The electronic device of claim 1, wherein the barometric equalization element is disposed between the membrane and the microphone, wherein the barometric equalization element includes an acoustic passage aligned with the acoustic port along an axis, and wherein the channel extends along a plane oriented transverse to the axis.

9. The electronic device of claim 8, wherein the barometric equalization element includes a first plate having a groove extending along the acoustic leak path and a second plate mounted on the first plate and covering the groove to define the channel between the second plate and a groove surface of the groove.

10. The electronic device of claim 1, wherein the barometric equalization element includes an open-cell foam layer having a plurality of interconnected pores within a material matrix, and wherein the channel is defined through the interconnected pores.

11. The electronic device of claim 1, wherein the trapped volume is in the encased space.

12. The electronic device of claim 1, wherein the membrane and the enclosure wall are on a same side of the casing wall.

13. An electronic device, comprising:

a casing having a casing wall separating a surrounding environment from an encased space, wherein the casing wall includes an acoustic port;

a membrane covering the acoustic port, wherein the membrane is impermeable to air;

a microphone in the encased space, wherein the microphone has an enclosure wall mounted on the casing wall, wherein a trapped volume is disposed between the membrane and the enclosure wall, and wherein the microphone includes a diaphragm in the trapped volume, the diaphragm having a front face facing a front compartment of the trapped volume and a rear face facing a rear compartment of the trapped volume;

a first barometric equalization element including a first channel having a first entrance port in fluid communication with the front compartment; and a second barometric equalization element including a second channel having a second entrance port in fluid communication with the rear compartment.

14. The electronic device of claim 13, wherein the first channel defines a first acoustic leak path between the front compartment and the encased space, and wherein the second channel defines a second acoustic leak path between the rear compartment and the encased space.

15. The electronic device of claim 14, wherein one or more of the first acoustic leak path or the second acoustic leak path includes a tortuous path between the respective compartment and the encased space.

16. The electronic device of claim 14, wherein the first channel includes a first exit port spaced apart from the first entrance port by a first channel length, wherein the second channel includes a second exit port spaced apart from the second entrance port by a second channel length, and wherein the first channel length and the second channel length are equal.

17. The electronic device of claim 16, wherein the first entrance port is spaced apart from the second entrance port by a first distance, wherein the first exit port is spaced apart from the second exit port by a second distance, and wherein the first distance is greater than the second distance.

18. The electronic device of claim 17, wherein the first exit port is adjacent to the second exit port.

19. A microphone assembly, comprising:

a membrane, wherein the membrane is impermeable to air;

a microphone having an enclosure wall coupled to the membrane, wherein a trapped volume is disposed between the membrane and the enclosure wall, and wherein the enclosure wall is between the trapped volume and a surrounding environment; and a barometric equalization element including a channel having an entrance port in fluid communication with the trapped volume and an exit port at the surrounding environment, wherein the exit port is spaced apart from the entrance port by a channel length, and wherein the channel defines an acoustic leak path between the entrance port and the exit port.

20. The microphone assembly of claim 19, wherein the channel length is at least 20 times greater than a width of the exit port.

21. The microphone assembly of claim 20, wherein the acoustic leak path includes a tortuous path between the entrance port and the exit port.

22. The microphone assembly of claim 21, wherein the barometric equalization element includes a plurality of tubes interconnected by one or more chambers such that the channel extends along the acoustic leak path through respective inner lumens of the tubes and respective cavities of the chambers.

* * * * *